US007963524B2

(12) United States Patent
Ohta

(10) Patent No.: US 7,963,524 B2
(45) Date of Patent: Jun. 21, 2011

(54) IMAGE FORMING APPARATUS

(75) Inventor: Yoshihide Ohta, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/461,995

(22) Filed: Aug. 31, 2009

(65) Prior Publication Data

US 2010/0052252 A1 Mar. 4, 2010

(30) Foreign Application Priority Data

Sep. 1, 2008 (JP) ..... 2008-223080

(51) Int. Cl.
*B65H 31/00* (2006.01)

(52) U.S. Cl. ..... 271/213; 271/207

(58) Field of Classification Search ..... 271/207, 271/213, 303
See application file for complete search history.

(56) References Cited

U.S. PATENT DOCUMENTS

| | | | | |
|---|---|---|---|---|
| 4,447,167 | A * | 5/1984 | Euteneuer et al. | 400/625 |
| 6,634,640 | B1 * | 10/2003 | Yoshizawa et al. | 271/213 |
| 7,216,866 | B2 * | 5/2007 | Taniguchi | 271/303 |
| 7,431,294 | B2 * | 10/2008 | Taniguchi | 271/303 |
| 7,448,618 | B2 * | 11/2008 | Inoue et al. | 271/207 |
| 7,648,137 | B2 * | 1/2010 | Ogashiwa | 271/207 |
| 2007/0205552 | A1 * | 9/2007 | Taniguchi | 271/303 |
| 2008/0006166 | A1 | 1/2008 | Ohkubo et al. | |
| 2008/0175620 | A1 | 7/2008 | Ohta et al. | |
| 2009/0022534 | A1 * | 1/2009 | Taniguchi | 399/397 |

FOREIGN PATENT DOCUMENTS

| | | | |
|---|---|---|---|
| JP | 01127562 | A * | 5/1989 |
| JP | H05-197225 | A | 8/1993 |
| JP | 2000-118841 | | 4/2000 |
| JP | 2002-68564 | | 3/2002 |
| JP | 2002-211819 | | 7/2002 |
| JP | 2007-76805 | | 3/2007 |

* cited by examiner

*Primary Examiner* — Kaitlin S Joerger
(74) *Attorney, Agent, or Firm* — Harness, Dickey & Pierce, P.L.C.

(57) ABSTRACT

An image forming apparatus to form an image on a sheet of recording media includes a discharge port formed in an upper portion of a main body of the image forming apparatus and exposed from above, a discharge portion to which the sheet is discharged, disposed downstream from the discharge port in a direction in which a sheet is discharged, a discharge roller disposed at the discharge port, a facing member disposed facing the discharge roller, forming a discharge nip together with the discharge roller, and a rotatable sheet discharge member. The sheet discharge member is provided in the discharge portion to form a sloped portion continuous with a downstream side of the discharge port in the direction in which the sheet is discharged. Rotation of the sheet discharge member causes a position of the discharge nip to change.

11 Claims, 15 Drawing Sheets

IMAGE FORMING APPARATUS

CROSS-REFERENCE TO RELATED APPLICATIONS

This patent specification is based on and claims priority from Japanese Patent Application No. 2008-223080, filed on Sep. 1, 2008 in the Japan Patent Office, which is hereby incorporated by reference herein in its entirety.

BACKGROUND OF THE INVENTION

1. Field of the Invention

The present invention generally relates to an image forming apparatus such as a copier, a printer, a facsimile machine, or a multifunction machine including at least two of those functions.

2. Discussion of the Background Art

In general, in image forming apparatuses, such as copiers, printers, facsimile machines, or multifunction machines including at least two of those functions, etc., sheets of recording media on which images are formed are discharged by a pair of rollers, a driving roller and a driven roller, onto a discharge tray.

Recently, to make the image forming apparatuses more compact while improving usability thereof such as removability of output sheets from the discharge tray, several approaches, described below, have been advanced.

For example, in one known image forming apparatus, the driven roller serving as the discharge roller can rotate around a shaft of the driving roller serving as the other discharge roller. Thus, the position of a discharge nip where the driving roller and the driven roller contact is changed, so that the direction in which the sheet is discharged to the discharge tray (hereinafter "sheet discharge direction") is vertically variable according to the size of the sheet enabling the sheet to be neatly stacked on the discharge tray.

Although the sheets can be stacked on the discharge tray neatly in this configuration, this configuration does not contribute to the removability of the output sheets from the discharge tray. Moreover, because only the driven roller can move, the angle at which the sheet enters the discharge nip changes significantly in practice, which can invite jamming of the sheet before and after the driven roller is moved. Thus, it is difficult to attain reliable discharge of sheets.

Therefore, in this configuration, in addition to the sheet discharge direction, it is necessary that the direction (angle) of the discharge tray be movable to stack the sheets neatly on the discharge tray. In addition, it is necessary to change the shape of a transport guide in conjunction with the change of the sheet discharge direction to improve sheet transport.

Moreover, in the configuration in which the sheet discharge direction is changed by changing the position of only the driven roller, discharge of sheets would be difficult when only the direction of the discharge nip is changed without changing a sheet transport path, that is, the angle at which the sheet initially contacts the discharge roller. In smaller image forming apparatus such as printers, because the sheet transport path is more curved, the output sheets are likely to curl, and the range of cardboard thicknesses that the image forming apparatuses can accommodate will decrease.

Another known image forming apparatus includes a sheet discharge space inside a housing thereof to reduce the area required to install the image forming apparatus. The image forming apparatus further includes a fixed lower tray disposed beneath a discharge port provided in the sheet discharge space and an movable upper tray disposed above the fixed lower tray. A downstream portion of the upper tray in the sheet discharge direction is supported by a shaft perpendicular to the sheet discharge direction so as to be vertically rotatable. The upper tray can be lowered until a space between its loading face and the discharge port is equal to a height of the sheets that the upper tray can accommodate. As the upper tray can be lifted until its bottom face is above the discharge port, the sheet can be discharged onto the lower tray through the identical discharge port.

Yet in another image forming apparatus, an additional tray can be attached thereto in addition to an existing discharge tray so that output sheets can be stacked on separate trays according to its operational modes, such as print mode and facsimile mode. The image forming apparatus further includes a switching guide to switch the sheet discharge direction between a direction leading to the existing tray and that leading to the additional tray, and a driving connector that drives a discharge member to discharge the sheet. When the additional tray is used, the driving connector causes the switch guide as well as the discharge member to discharge the sheet to the additional tray using a driving force of a transport member to transport the sheet to the existing tray.

However, increasing the number of discharge trays makes management of components more complicated. It might happen that the additional tray is missing when users desires to use it.

Herein, regarding usability, it is preferable that jammed sheets can be removed easily from the image forming apparatuses. For example, in typical tandem multicolor image forming apparatuses, a sheet transport path is disposed at a front side of the image forming apparatus so that jammed sheets can be removed from the front side.

Although such an arrangement has advantages it also has several drawbacks. For example, as the sheet discharge port is disposed on the front side, the sheet discharge port is an obstacle to the visibility and accessibility from the front side as well as from a lower side.

This problem may be solved by using a movable tray that can rotate to a substantially vertical position so that the output sheets can be kept substantially vertically. However, a subsequent sheet will be discharged at such an angle that its leading edge hits the sheets already stacked on the movable tray, which increase possibilities of damage to the stacked sheets and/or sheet jamming.

In view of the foregoing, there is a need to maintain a constant stress to a face on which the sheet is stacked so as to stack the sheets neatly thereon even when the sheet discharge direction is changed, which known image forming apparatuses fail to do.

SUMMARY OF THE INVENTION

In view of the foregoing, one illustrative embodiment of the present invention provides an image forming apparatus to form an image on a sheet of recording media. The image forming apparatus includes a discharge port formed in an upper portion of a main body of the image forming apparatus and exposed from above, a discharge portion disposed downstream from the discharge port in a direction in which a sheet is discharged, a discharge roller disposed at the discharge port, a facing member disposed facing the discharge roller, and a rotatable sheet discharge member forming a sloped portion provided in the discharge portion, continuous with a downstream side of the discharge port in the direction in which the sheet is discharged. The discharge roller and the facing member together form a discharge nip through which the sheet is discharged from the main body to the discharge portion. Rotation of the sheet discharge member causes a position of the discharge nip to change.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
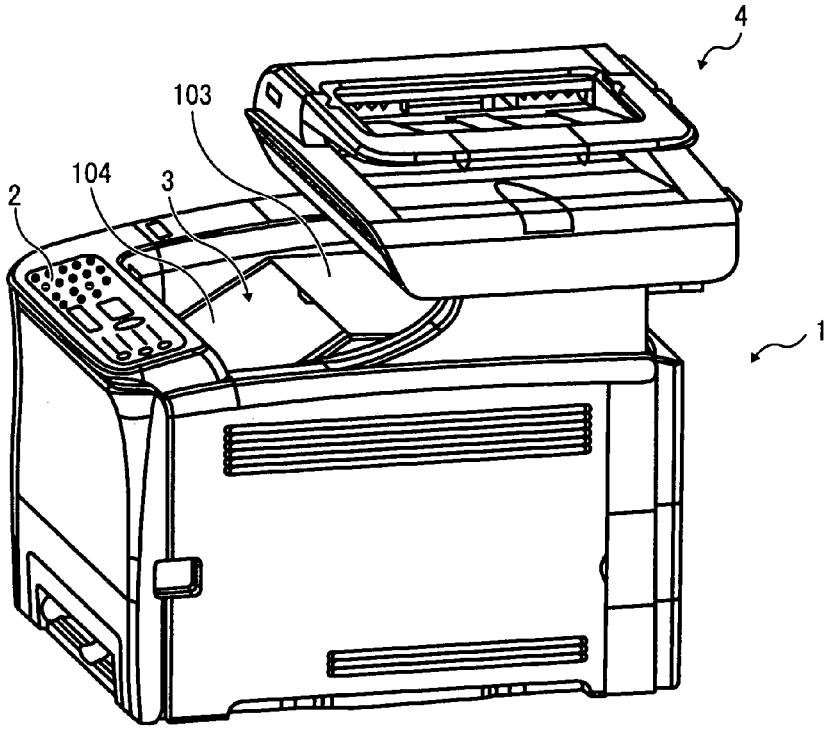
FIGS. 1A and 1B each illustrate an exterior of an image forming apparatus according to an illustrative embodiment of the present embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 1B:
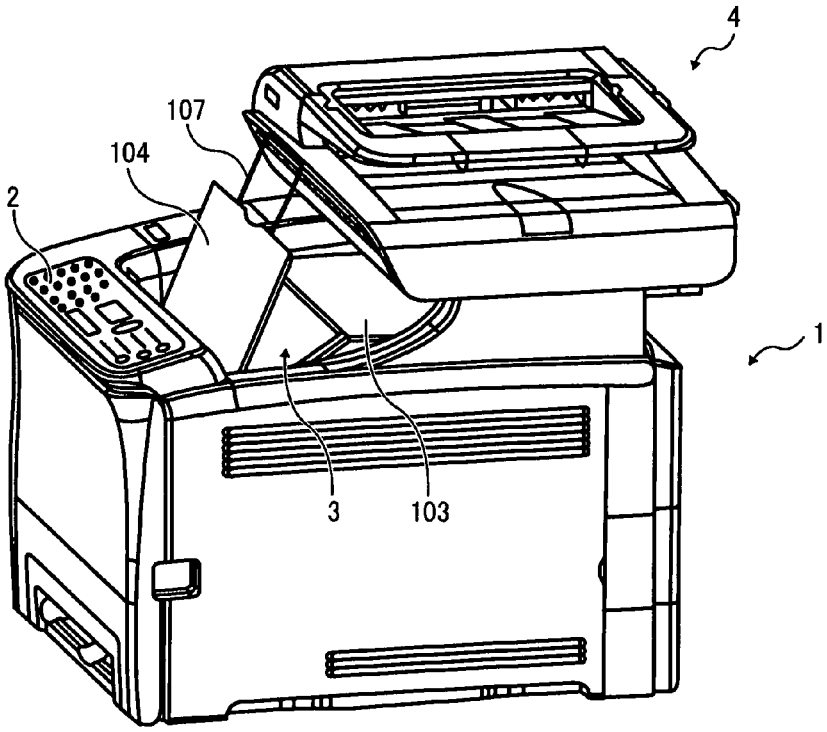

Referring now to the drawings, wherein like reference numerals designate identical or corresponding parts throughout the several views thereof, and particularly to FIGS. 1A and 1B, an image forming apparatus according to an illustrative embodiment of the present invention is described.

Each of FIGS. 1A and 1B is a perspective view illustrating an exterior of the image forming apparatus that in the present embodiment is a multifunction device capable of printing and copying. It is to be noted that the present invention may be applied to various devices capable of image forming not limited to a printer.

As shown in FIGS. 1A and 1B, the image forming apparatus includes a main body 1, a control panel 2 provided on an upper side of the main body 1, a discharge portion 3 provided above the main body 1, a first discharge tray 103, a second discharge tray 104, serving as a sheet discharge member, that is continuous with the first discharge tray 103, an extension tray 107, and a scanner 4 to read image data of an original document, disposed above the discharge portion 3.

Although not shown in the drawings, the main body 1 includes an image forming unit to form an electrostatic latent image on an image carrier such as a photoconductor drum and to develop the latent image with developer such as toner. The developed image is then transferred by a transfer unit, not shown, onto a sheet of recording media.

The control panel 2 is disposed above the discharge unit 3. Therefore, the image forming apparatus can be more compact. More specifically, although the control panel 2 may be disposed on the scanner 4, the position of the scanner 4 should be higher or closer to a back end of the main body 1 in such a configuration so as not to obstruct the sheets discharged from the main body 1 in a vertical direction shown in FIG. 1B.

In other words, as the sheets are stacked in a portion closer to the front side of the main body 1 than the scanner 4 is in the present embodiment, sheets may degrade accessibility to and visibility of the control panel 2 if the control panel 2 is disposed on the front side of the scanner 4. Although this inconvenience can be prevented when the scanner 4 is disposed in a position higher or closer to the back end of the main body 1, which makes the image forming apparatus more bulkier.

By contrast, in the present embodiment, the control panel 2 is disposed on the front side of the image forming apparatus, closer to the front end than the scanner 4 is, and thus the sheets does not block the access to the control panel 2 while keeping the image forming apparatus relatively compact.

In addition, when the control panel 2 is disposed on a relatively low position on a front side of the image forming apparatus, access thereto is relatively easy even when the image forming apparatus is disposed on a rack or the like.

Figure 2A:
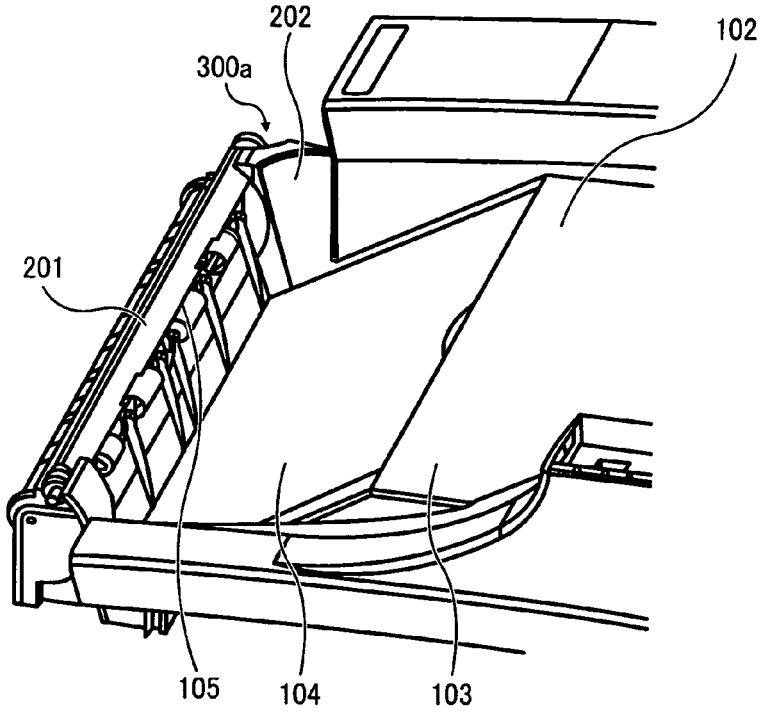
FIGS. 2A and 2B each illustrate configurations around a discharge port in the image forming apparatus shown in FIGS. 1A and 1B.

An upper surface of the main body 1 serves as a first discharge face 102 shown in FIG. 2A.

Figure 2B:
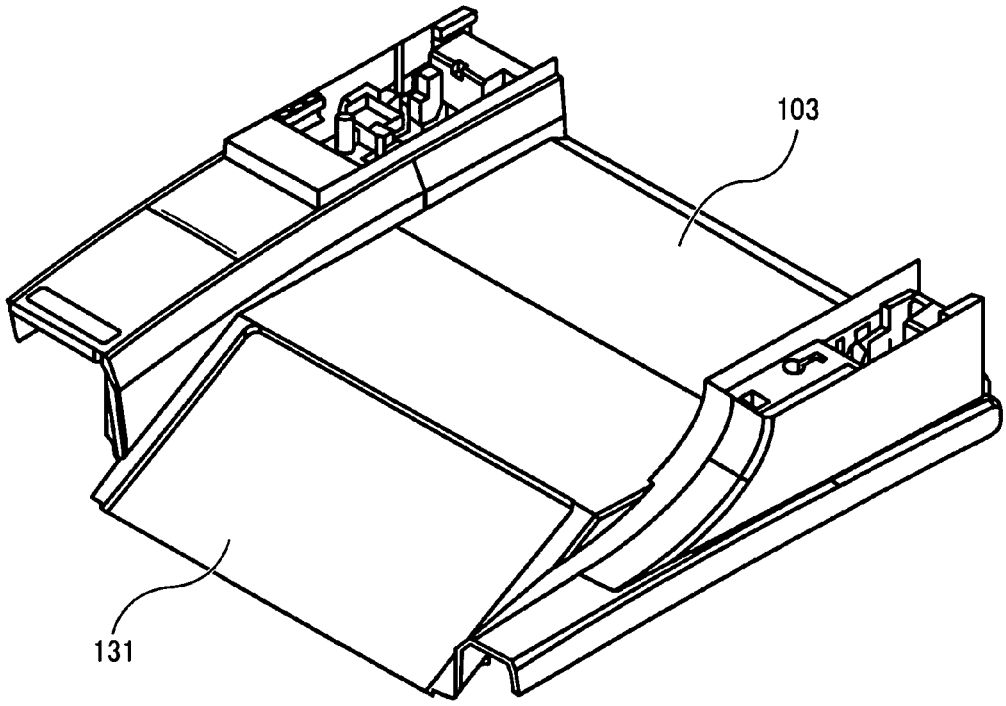

FIGS. 2A and 2B illustrate a configuration around a discharge port 105 in the image forming apparatus according to the present embodiment.

As shown in FIGS. 2A and 2B, the discharge port 105 is formed by a discharge roller holder 201, a discharge frame 202, and the second discharge tray 104. In a standard state, the sheets discharged from the discharge port 105 are stacked on the first discharge face 102 that extends in a direction in which the sheets are discharged (hereinafter "sheet discharge direction"). The first discharge face 102 is formed by the second discharge tray 104 continuous with the downstream side of the discharge port 105 in the sheet discharge direction and the first discharge tray 103 continuous with the second discharge tray 104. The second discharge tray 104 forms a sloped portion of the first discharge face 102. Reference characters 300*a* represent an area in which a discharge driving motor 300 (shown in FIG. 5) is disposed.

As shown in FIG. 2B, the upper surface of the main body 1 includes a recessed portion 131 in which the second discharge tray 104 is housed so as to be contained within a sloped portion leading from a downstream side of the discharge port 105 in the sheet discharge direction. In a first usage form, the second discharge tray 104 is contained in the recessed portion 131, forming the first discharge face 102 together with the first discharge tray 103, and the sheets discharged from the discharge port 105 are stacked on the first discharge face 102. In a second usage form, the second discharge tray 104 is rotated upward, and the discharged sheets are stacked on the second discharge tray 104.

Figure 3A:
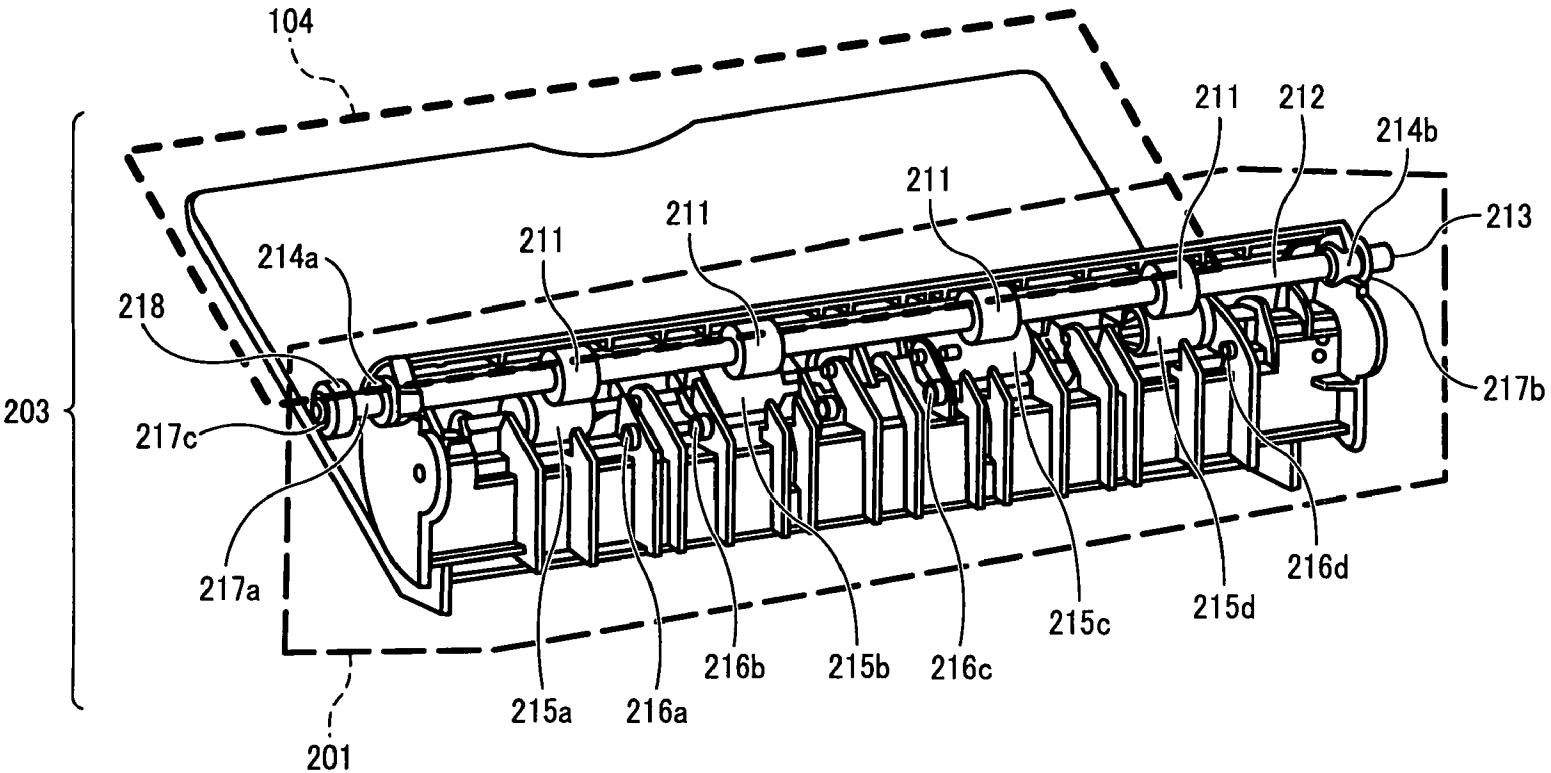
FIG. 3A illustrates a configuration of a discharge roller holder and a second discharge tray integrated together.
Figure 3B:
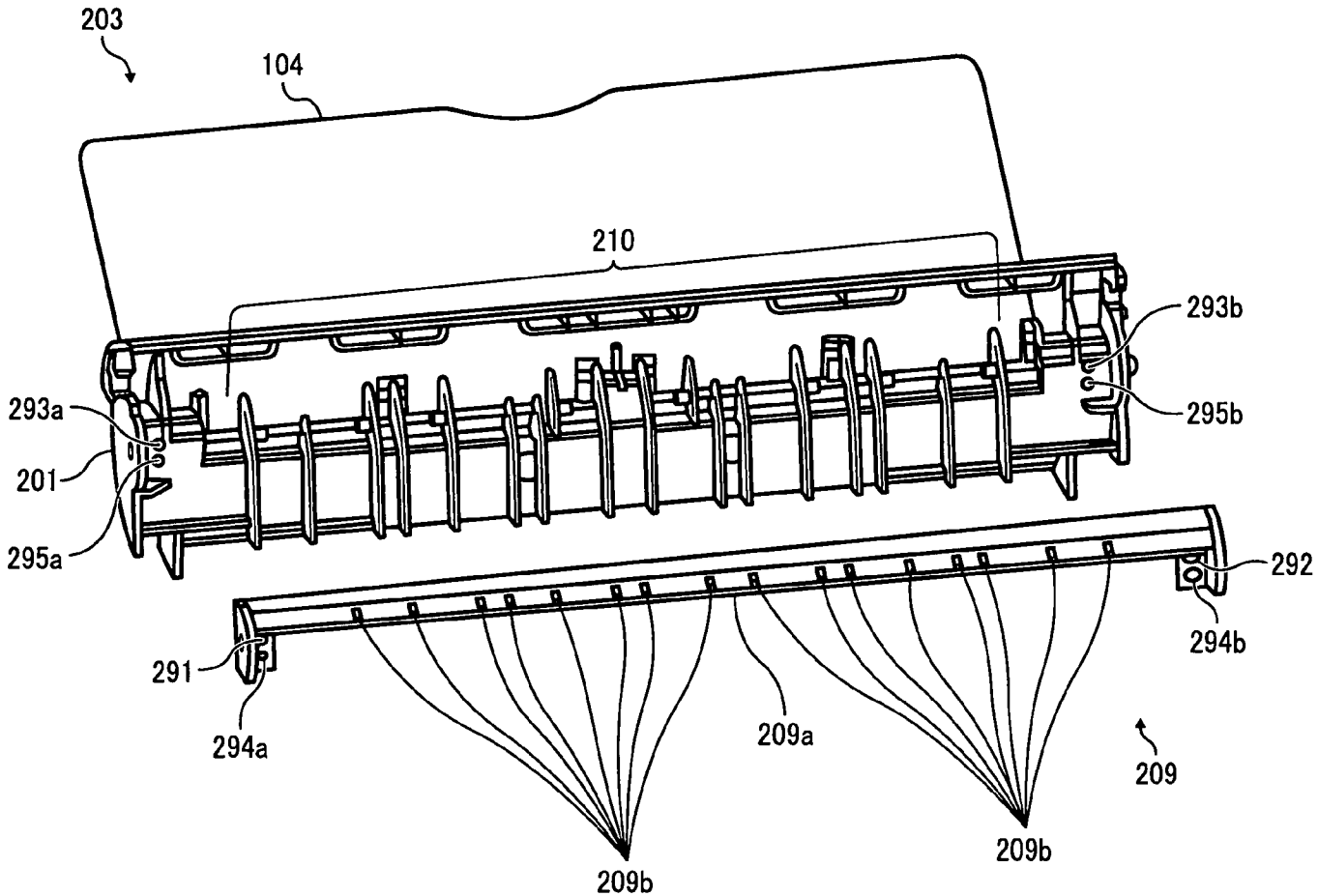
FIG. 3B illustrates mounting of a facing guide to the discharge roller holder shown in FIG. 3A.

FIGS. 3A and 3B illustrate a configuration when the discharge roller holder 201 and the second discharge tray 104 are integrated as a single unit, and FIGS. 4A through 4F illustrates states of a rotary unit 203.

As shown in FIG. 3A, the discharge roller holder 201 and the second discharge tray 104 together form the rotary unit 203 in which a discharge roller 213 is rotatably held by bearings 214*a* and 214*b* and attached to the discharge roller holder 201 with retaining rings 217*a* and 217*b* that prevent the discharge roller 213 from slipping out of the bearings 214*a* and 214*b*. The discharge roller 213 includes rubber rollers 211 attached to a metal shaft 212. The rubber rollers 211 of the discharge roller 203 respectively face facing rollers 215*a*, 215*b*, 215*c*, and 215*d* that are constantly pressed against the discharge roller 213 (rubber rollers 211) with wire springs 216*a*, 216*b*, 216*c*, and 216*d*, respectively. The discharge roller 213 includes a D-shaped cut portion to which a driven gear 218 is attached with a retaining ring 217*c* so as not to slip out therefrom. The sheets are discharged through discharge roller nips where the rubber rollers 211 presses against respective facing rollers 215*a*, 215*b*, 215*c*, and 215*d*.

It is to be noted that the facing rollers 215*a*, 215*b*, 215*c*, and 215*d* are simply referred to as the facing rollers 215 when the discrimination therebetween is not necessary.

Referring to FIG. 3B, the discharge roller holder 201 further includes a transport rib 210, and a facing guide 209 is screwed to the discharge roller holder 201. More specifically, positioning bosses 293*a* and 293*b* of the discharge roller holder 201 respectively fit in a hole 291 and a long hole 292 formed in the facing guide 209. Further, a screw, not shown, penetrates a hole 294*a* formed in the facing guide 209 and then engages a screw hole 295*a* formed in the discharge roller holder 201. Similarly, another screw, not shown, penetrates a hole 294*b* formed in the facing guide 209 and then engages a screw hole 295*b* formed in the discharge roller holder 201.

Figure 4A:
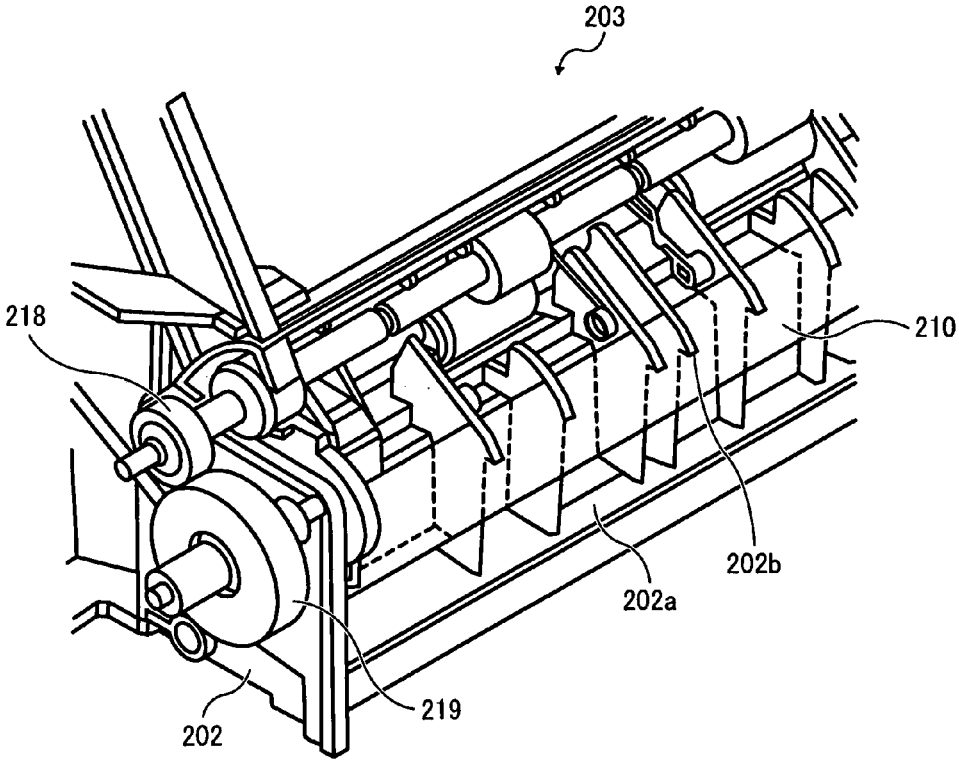
FIGS. 4A, 4B, and 4C each illustrate a state of a rotary unit when the rotary unit is at a first discharge position (e.g., standard position)
Figure 4B:
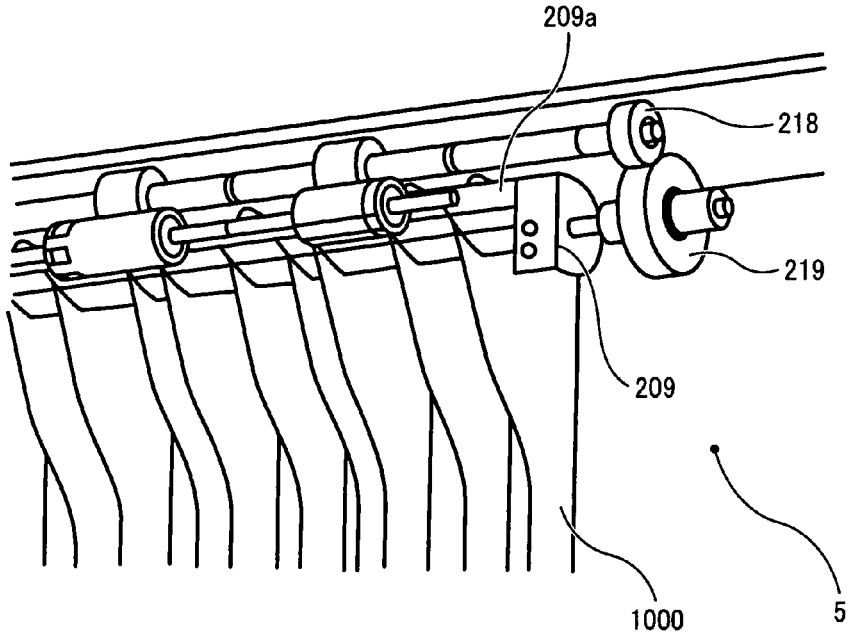
Figure 4C:
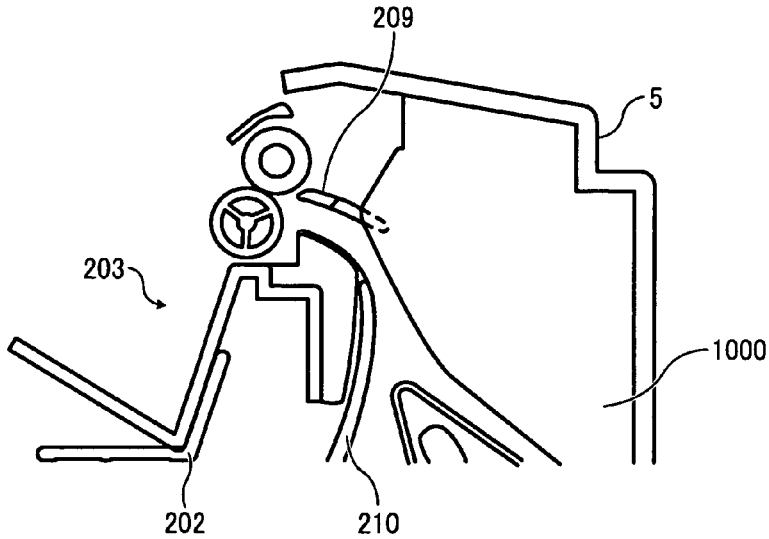

The facing guide 209 includes a transport face 209*a* disposed on a back of a side shown in FIG. 3B, and notches 209*b* are formed in the transport face 209*a*. As indicated by dotted lines shown in FIGS. 4C and 4F, the notches 209*b* overlap a transport rib 1000 formed on a front cover 5, on a back side of the paper on which FIGS. 4C and 4F are drawn. In other words, the discharge roller holder 201, the second discharge tray 104, and the facing guide 209 are integrated into the single rotary unit 203. Rotation of the rotary unit 203 is described below with reference to FIGS. 4A through 4F, 8A, and 8B.

Figure 5:
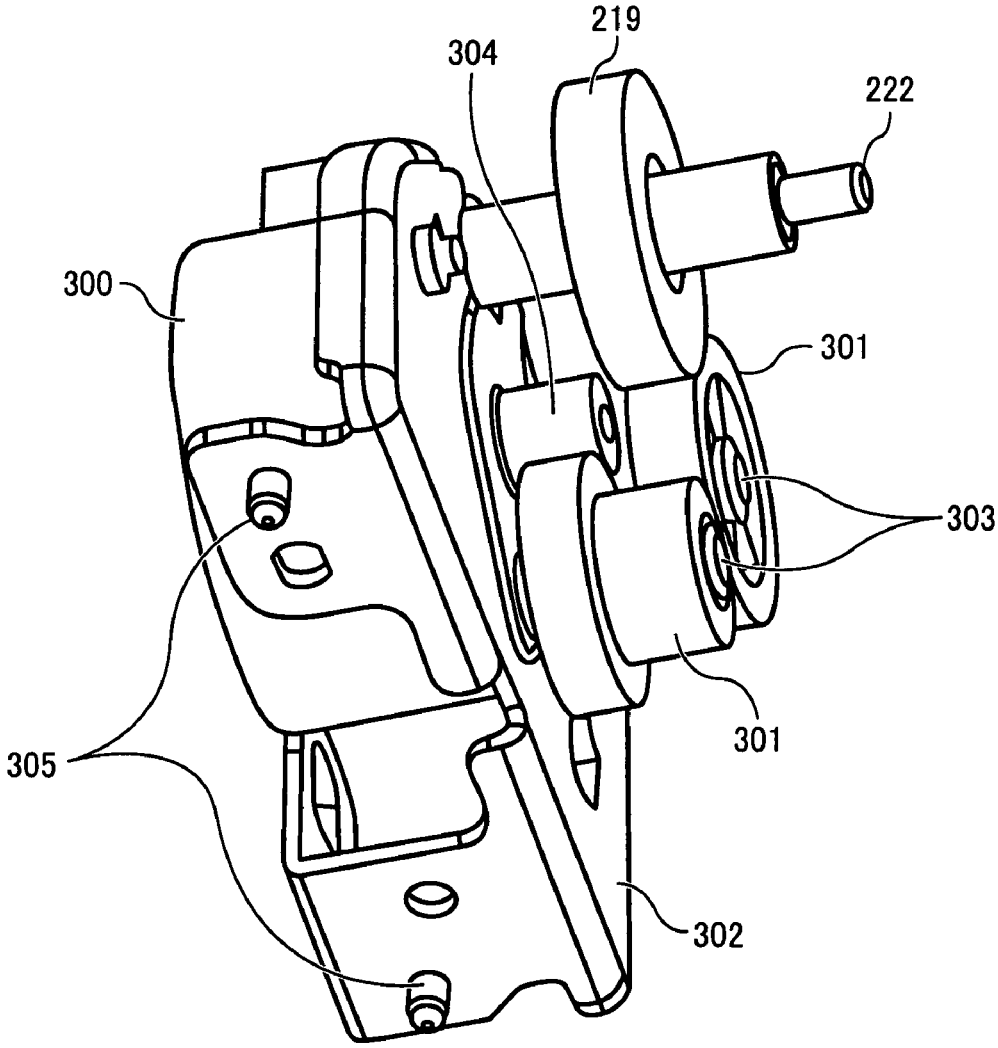
FIG. 5 illustrates a mechanism to transmit a driving force from a discharge driving motor to the discharge roller unit.

FIG. 5 illustrates a discharge driving unit to rotate the second discharge tray 104 in conjunction with the discharge roller holder 201.

Referring to FIG. 5, the discharge driving unit includes the discharge driving motor 300, a driving transmission gear 219, a stud shaft 222, a gear line 301, a bracket 302, studs 303, a motor driving gear 304, and the driven gear 218 of the discharge roller holder 201. The discharge driving motor 300 is fixed by screws 305 to the main body 1 of the image forming apparatus.

The driving force of the discharge driving motor 300 is transmitted to the driving transmission gear 219 via the gear line 301. The studs 303 provided on the bracket 302 set a distance between the axes of the gears in the gear line 301. The driving transmission gear 219 is held by the stud shaft 222. The driving force is further transmitted from the driving transmission gear 219 to the driven gear 218 of the discharge roller holder 201. As the discharge roller holder 201 and the second discharge tray 104 are integrally formed in the present embodiment, the second discharge tray 104 is rotated in conjunction with the discharge roller holder 201 by the discharge driving unit. The gear line 301, the driving transmission gear 219, and the driven gear 218 serves as a conjunction member to rotate the sheet discharge tray 104 in conjunction with the discharge roller holder 201.

Next, the discharge frame 202 is described in further detail below with reference to FIG. 6.

Figure 6:
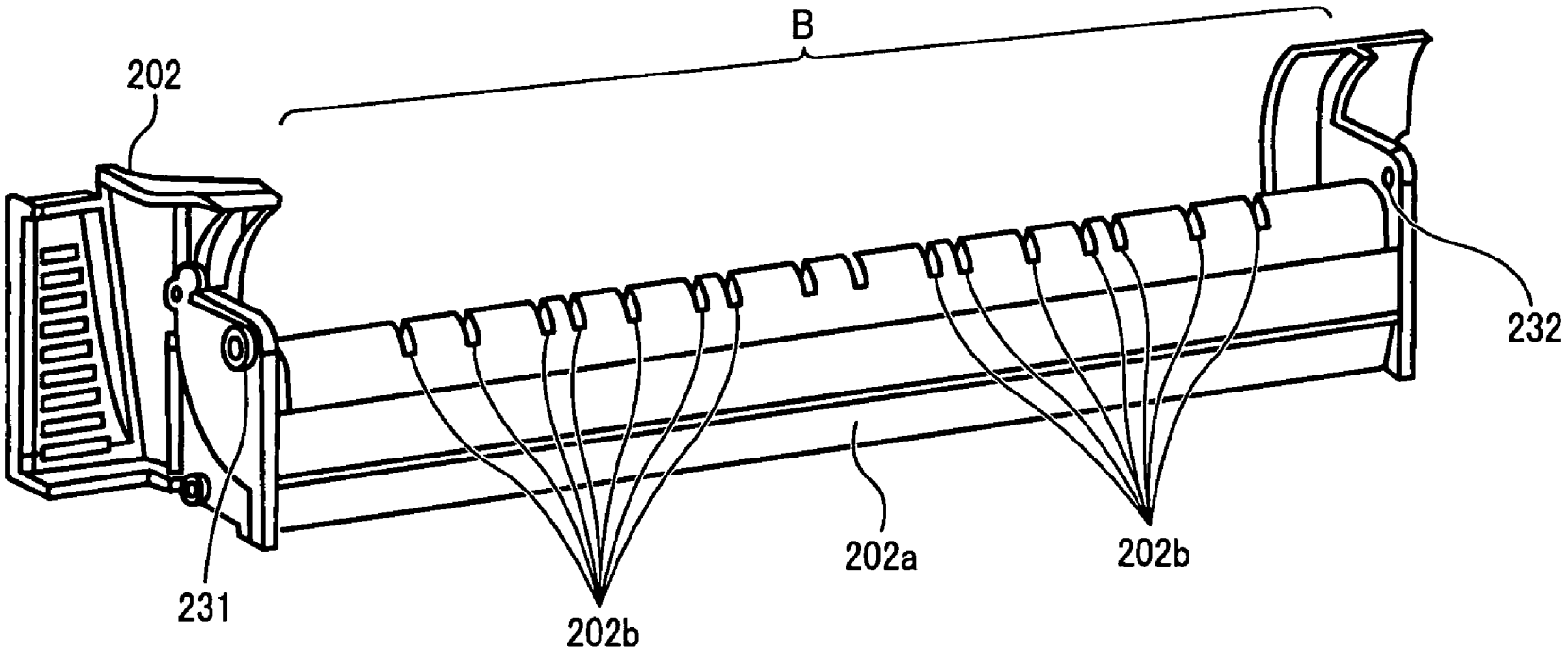
FIG. 6 is a perspective view illustrating a discharge frame.

In the configuration shown in FIG. 6, the discharge frame 202 includes retaining holes 231 and 232 disposed on both side faces thereof. The retaining hole 231 is on the side of a driving roller. The discharge frame 202 further includes an area B to which the discharge roller holder 201 is attached. When the discharge roller holder 201 is attached to the discharge frame 202, the discharge roller holder 201 can rotate within certain degrees around the retaining hole 231 without interfering with other components. The discharge frame 202 further includes a transport face 202*a* on the side of the second discharge tray 104, and notches 202*b* formed in the transport face 202*a* engage the transport rib 210 formed on the discharge roller holder 201, thus forming a continuous sheet transport path. This sheet transport path can be changed by rotating the discharge roller holder 201.

Figure 7:
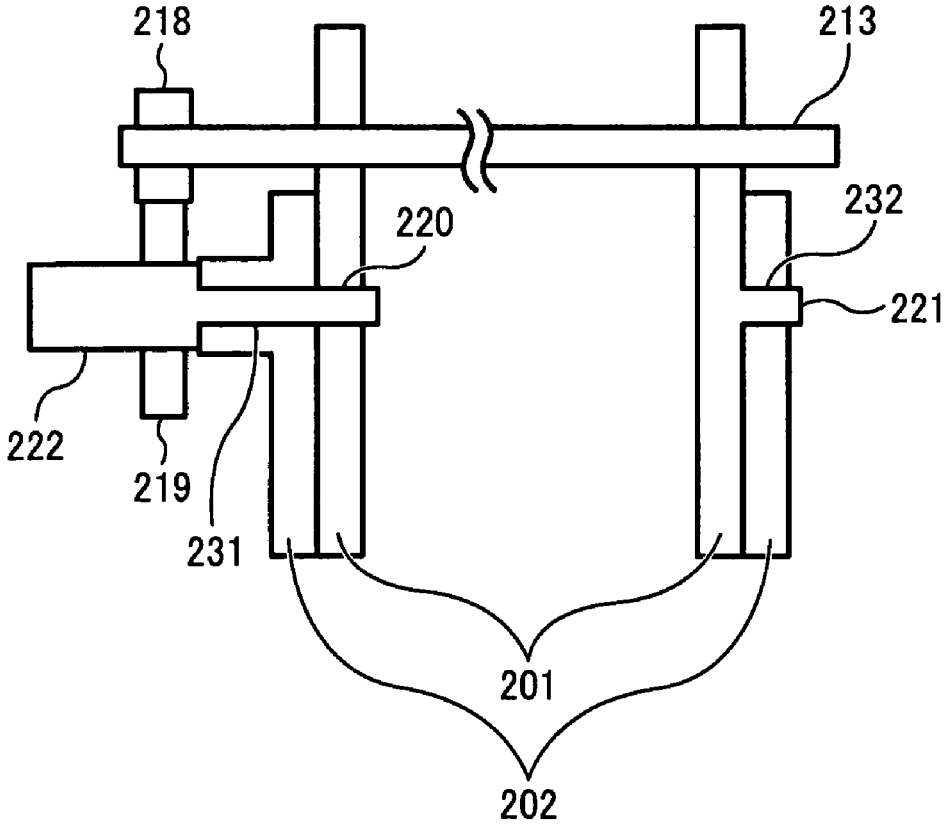
FIG. 7 illustrates a configuration of a discharge frame assembly.

Assembling the discharge frame 201 is described below with reference to FIG. 7.

The discharge roller holder 201 includes a rotary shaft hole 220 and a rotary protrusion 221. When the discharge roller holder 201 is disposed in the area B of the discharge frame 202, the stud shaft 222 penetrates the retaining hole 231 formed in the discharge frame 202 and enters the rotary shaft hole 220. Further, the rotary protrusion 221 engages the retaining hole 232 formed in the discharge frame 202. Thus, the discharge roller holder 201 is rotatably attached to the discharge frame 202 and can rotate smoothly. In addition, as the rotary axis is coaxial with the driving transmission gear 219, the distance between the axes of the driving transmission gear 219 and the driven gear 218 is not changed even when the discharge roller holder 201 rotates.

Alternatively, the discharge roller holder 201 and the second discharge tray 104 may be separate components that are connected with link members so that the discharge roller holder 201 can rotate in conjunction with the second discharge tray 104. In this configuration, relative positions of the discharge port 105, the first discharge tray 103, and the second discharge tray 104 can be adjusted as required when rotational position of the rotary unit 203 is changed. Although, depending on the angle at which the sheets are discharged, the sags of the sheets due to its weight differ, and accordingly the position to which the sheets drop and the angle at which the sheets drop slightly change, the sheets can be neatly stacked on the first discharge tray 103 or the second discharge tray 104 by adjusting the relative positions of the first discharge tray 103 and the second discharge tray 104 to the discharge port 105 in this configuration.

Figure 8A:
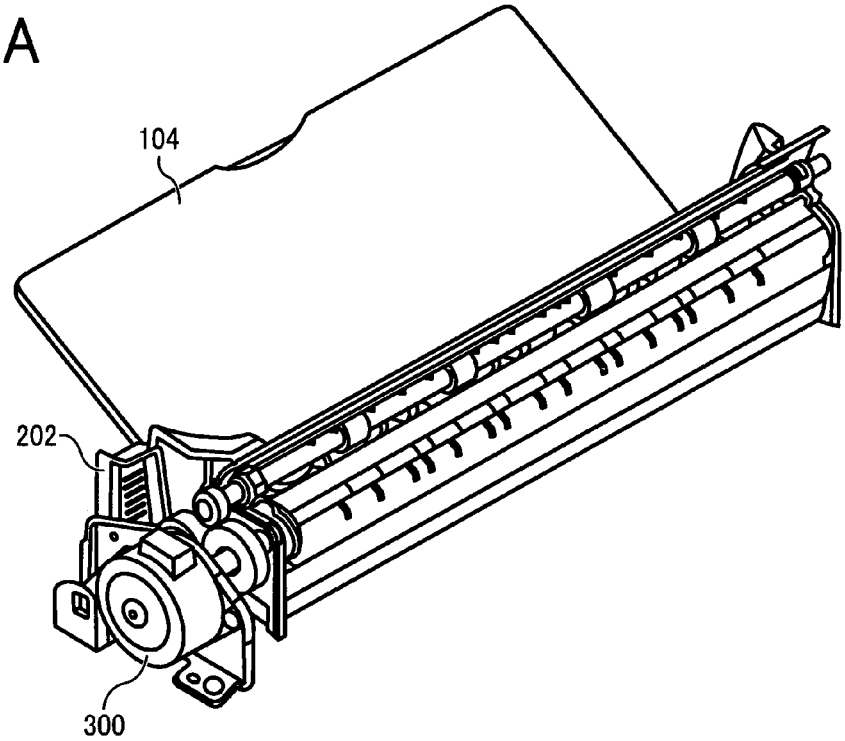
FIGS. 8A and 8B are perspective views illustrating the discharge roller holder at the first discharge position and the second discharge position, respectively.
Figure 8B:
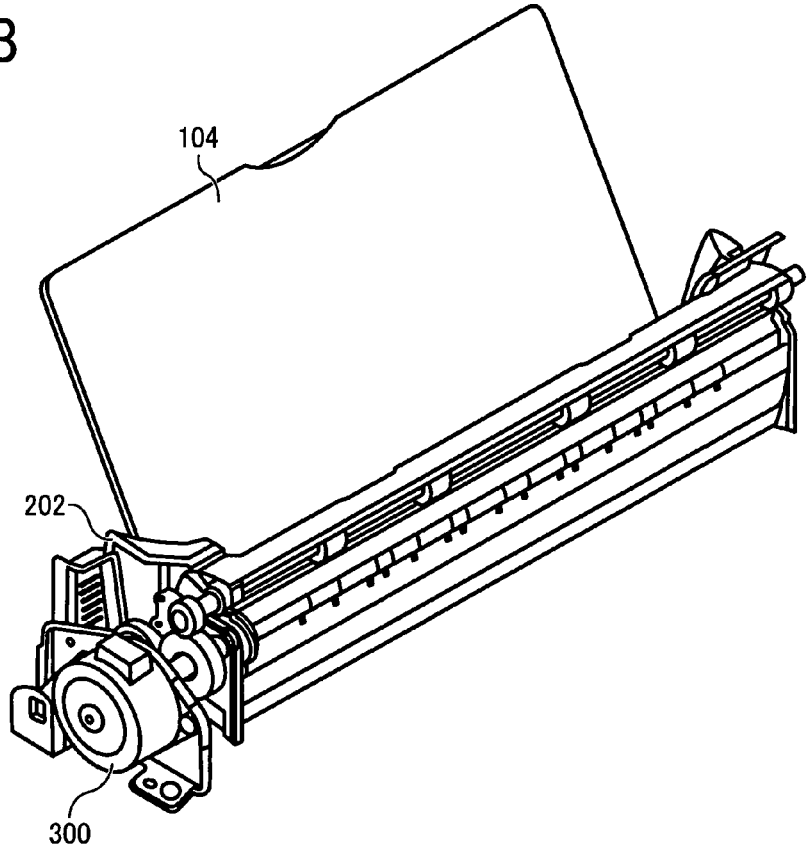
Figure 9A:
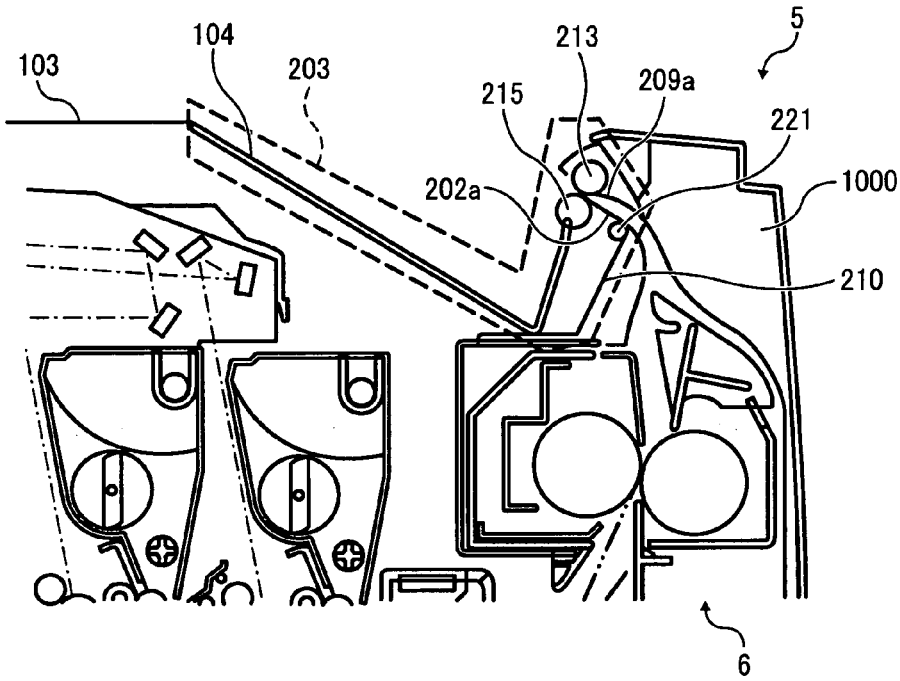
FIGS. 9A and 9B are enlarged views illustrating main components of the rotary unit at the first discharge position and the second discharge position, respectively.
Figure 9B:
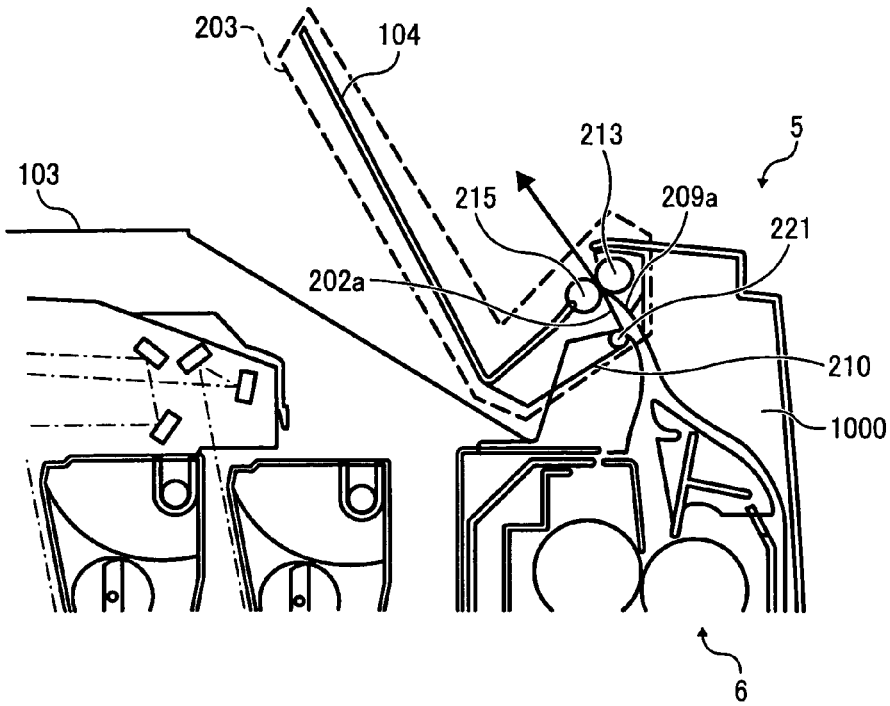

Descriptions will be made below of the rotation of the rotary unit 203 with reference to FIGS. 4A through 4F, 8A, 8B, 9A, and 9B. FIGS. 8A and 8B are perspective views illustrating rotational positions of the rotary unit 203, and FIGS. 9A and 9B are enlarged views illustrating the rotational positions of the rotary unit 203. In FIGS. 9A and 9B, a reference numeral 6 represents a fixing device to fix the images formed on the sheets.

FIGS. 4A through 4C, 8A, and 9A illustrate a first discharge position or standard position in which the rotational position of the second discharge tray 104 is lower, and FIGS. 4D through 4F, 8B, and 9B, illustrate a second discharge portion or rotated position in which the rotational position of the second discharge tray 104 is higher.

Referring to FIGS. 4C and 4F, because the second discharge tray 104 and the discharge roller holder 201 are integrated together, the discharge roller holder 201 can rotate from the state shown in FIG. 4C to the state shown in FIG. 4F in conjunction with the second discharge tray 104. The position of the discharge nip is moved to the left in FIG. 4F from the state shown in FIG. 4C, and the direction in which the sheet is discharged is closer to the vertical direction in FIG. 4F than in the state shown FIG. 4C accordingly. In other words, the second discharge tray 104 can change the position of the discharge nip by rotating.

A configuration of a discharge guide before the discharge roller 213 is installed is formed by the transport rib 210 and the transport face 209*a*, which forms a part of the rotary unit 203. The rotary unit 203 further includes the second discharge tray 104 in the present embodiment as described above. Because these components are rotated around the axis of the driving transmission gear 219 shown in FIG. 5, the relative positions thereof do not change even when their rotational positions are changed.

More specifically, the configuration of the discharge guide in the present embodiment is determined by angles of the transport rib 210 and the transport face 209*a* to the discharge roller nip; and an angle between the second discharge tray 104 and the discharge direction from the discharge roller nip. By rotating the rotary unit 203 while keeping the configuration of the discharge guide constant, the direction in which the sheets are transported to the discharge runner 213 can be kept substantially constant, thereby transport performance can be reliable before and after the rotation of the rotary unit 203.

Figure 4D:
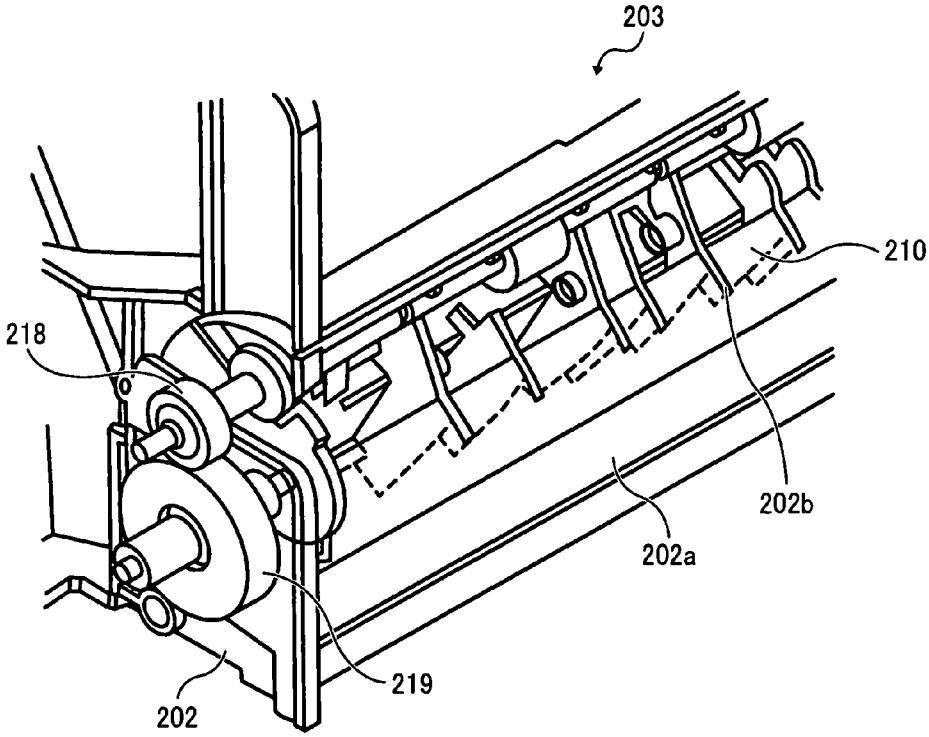
FIGS. 4D, 4E, and 4F each illustrate a state of the rotary unit when the rotary unit is at a second discharge position (e.g., rotated position)
Figure 4E:
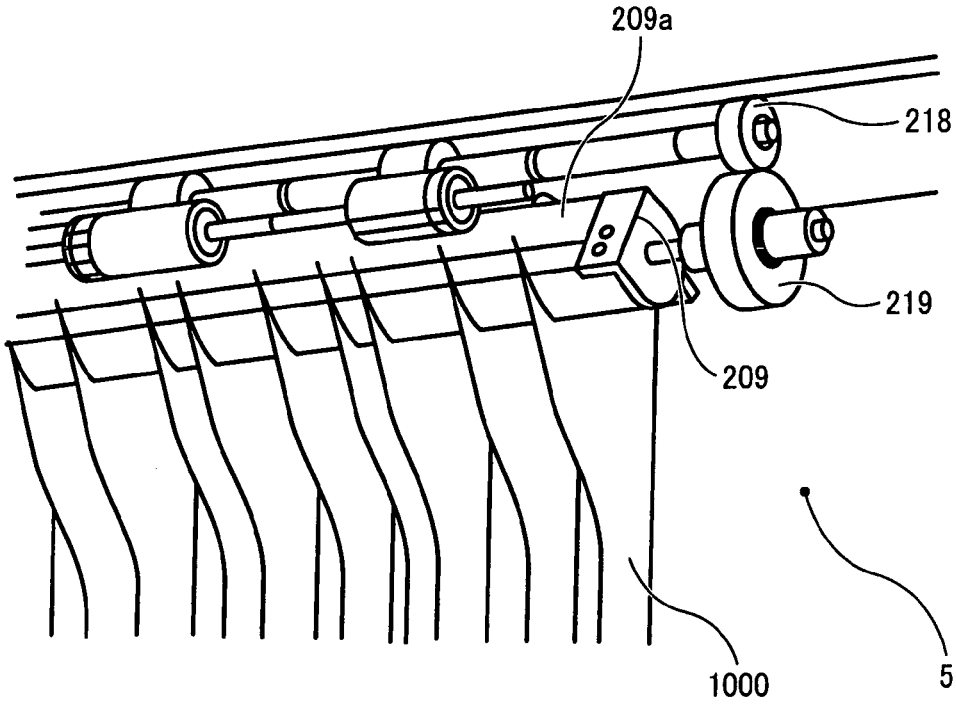
Figure 4F:
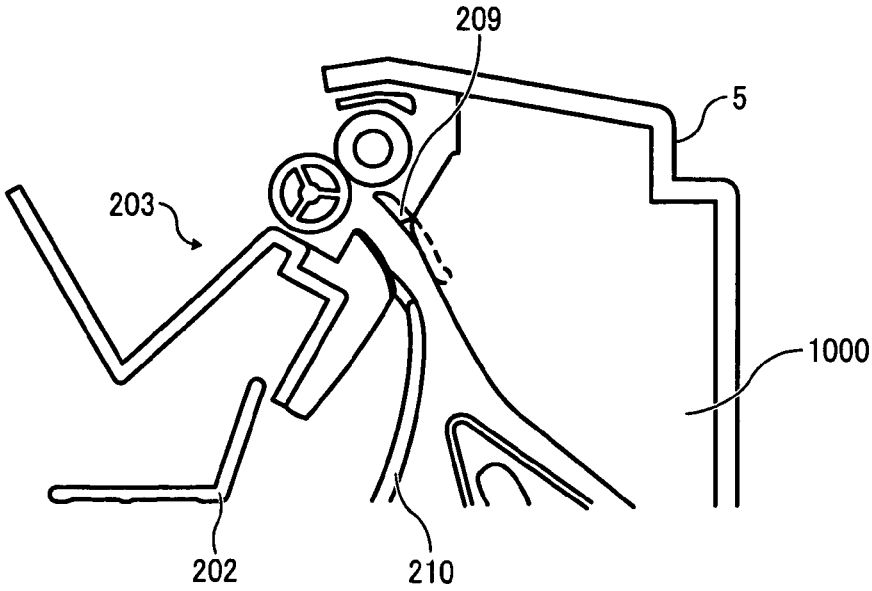

Moreover, in the second discharge position shown in FIGS. 4D, 8B, and 9B, that is, the rotational position of the second discharge tray 104 is higher, the transport path along which the sheet is transported from the fixing device 6 and discharged through the discharge nip, formed by the transport rib 210 and the transport face 209*a*, is relatively strait as shown in FIG. 4F and FIG. 9B.

Herein, the curvature of the transport path downstream from the fixing device 6 in the sheet discharge direction contributes to curl of the sheets, that is, the greater the curvature, the greater the degree of the curl of the sheets. Therefore, when this transport path is relatively straight, the curl of the sheets discharged from the image forming apparatus can be reduced. Although, to reduce the curl of the sheets, the temperature of the fixing device 6 (fixing temperature) is typically decreased, the speed at which the sheets pass through the fixing device 6 should be slowed accordingly, thereby maintaining the amount of heat that is attained when the temperature of the fixing device 6 is not decreased, to fully fix the images (e.g., toner images) on the sheets. As a result, printing speed is decreased. By contrast, in the present embodiment, because the transport path is relatively straight when the rotary unit 203 is in the second position shown in FIGS. 4D, 8B, and 9B, the curl of the sheets can be reduced without slowing the speed at which the sheets are transported. In addition, because changing the fixing temperature is not necessary, the control of the image forming apparatus can be simplified.

The second discharge tray 104 is described in further detail below with reference to FIGS. 10A through 10C that illustrate a back side of the second discharge tray 104 on which the extension tray 107 is attached.

Figure 10A:
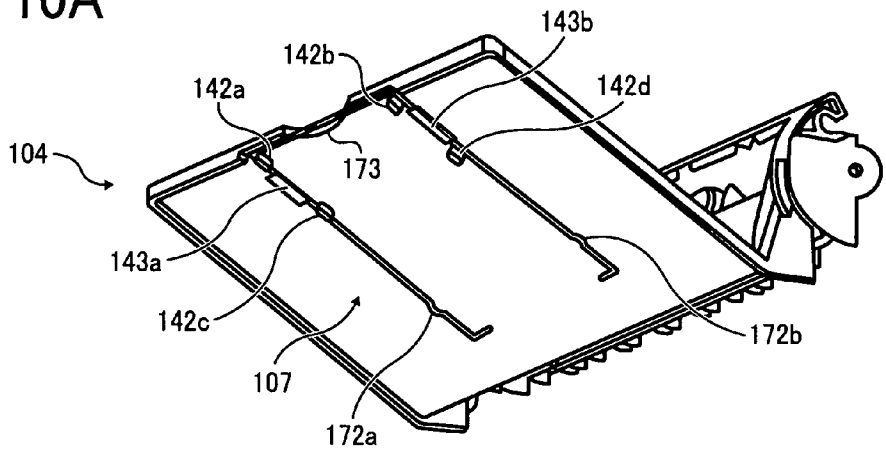
FIG. 10A illustrates the second discharge tray and an extension tray.
Figure 10B:
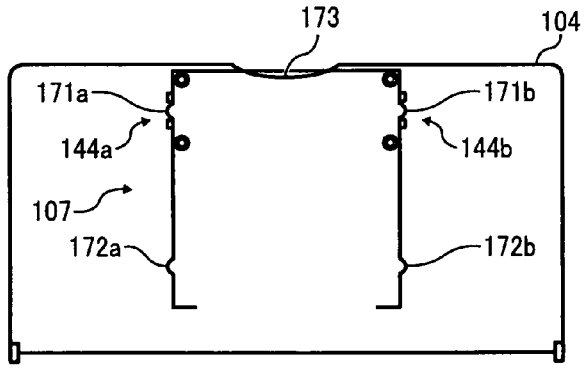
FIGS. 10B and 10C illustrate the extension tray at a first position (e.g., contracted position) and a second position (e.g., extended position), respectively.
Figure 10C:
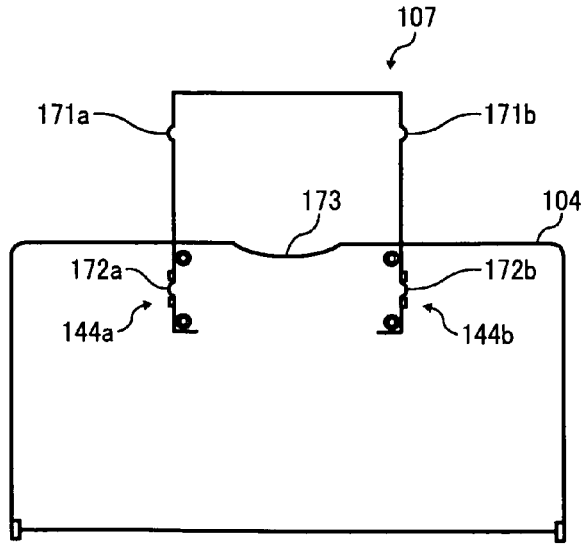

As shown in FIGS. 10A through 10C, the extension tray 107 is attached to the second discharge tray 104. The second discharge tray 104 includes guide bosses 142*a* through 142*d* to guide the extension tray 107, retaining members 143*a* and 143*b* that prevent the extension tray 107 from coming off the second discharge tray 104, and positioning grooves 144*a* and 144*b*. The extension tray 107 is slidably attached to the second discharge tray 104 with the retaining members 143*a* and 143*b*. The extension tray 107 includes first position protrusions 171*a* and 171*b*, and second position protrusions 172*a* and 172*b*.

The extension tray 107 is set at a first position or contracted position shown in FIG. 10B when the first position protrusions 171*a* and 171*b* engage the positioning grooves 144*a* and 144*b*, respectively, and at a second position or extended position shown in FIG. 10C when the second position protrusions 172*a* and 172*b* engage the positioning grooves 144*a* and 144*b*, respectively.

Moreover, as a recessed portion 173 is formed in a center portion in a downstream edge portion of the second discharge tray 104 in the sheet discharge direction, the extension tray 107 is visible and can be accessed even when the extension tray 107 is at the first position (contracted position). Thus, a user can draw the extension tray 107 to the extension position.

The extension tray 107 is formed of a linear material such as wire in the present embodiment, and thus hindrance to the visibility of and access to the scanner 4 can be limited even when the extension tray 107 is extended to a front side of the scanner 4. It is to be noted that, although the extension tray 107 is a substantially rectangle formed of wire in the present embodiment, its shape is not limited thereto. Alternatively, various different shapes, such as a triangle or a certain polygon, can be adopted as the shape of the extension tray 107 as long as it forms a sheet discharge face. Also, its material is not limited to the linear material, and the extension tray 107 may be a transparent plastic plate that can maintain a sufficient degree of visibility of the scanner 4.

It is to be noted that the configuration of the second discharge tray 104 is not limited to specific configurations as long as it provides a flat discharge face and is rotatably attached to the main body 1 of the image forming apparatus. For example, the second discharge tray 104 may be plate-shaped or formed with a linear material such as wire similarly to the extension tray 107. In addition, when the second discharge tray 104 is configured to rotate integrally with the discharge roller holder 201, the operation thereof can be simplified. Although it is preferable that, as in the present embodiment, the second discharge tray 104 can rotate integrally and coaxially with the discharge roller holder 201, the present invention is not limited thereto. Alternatively, the second discharge tray 104 may be separate from the discharge roller holder 201 so as to be separately attached to the image forming apparatus.

Referring to FIGS. 11, 12A through 12C, rotation of the discharge roller holder 201 is described blow.

Figure 11:
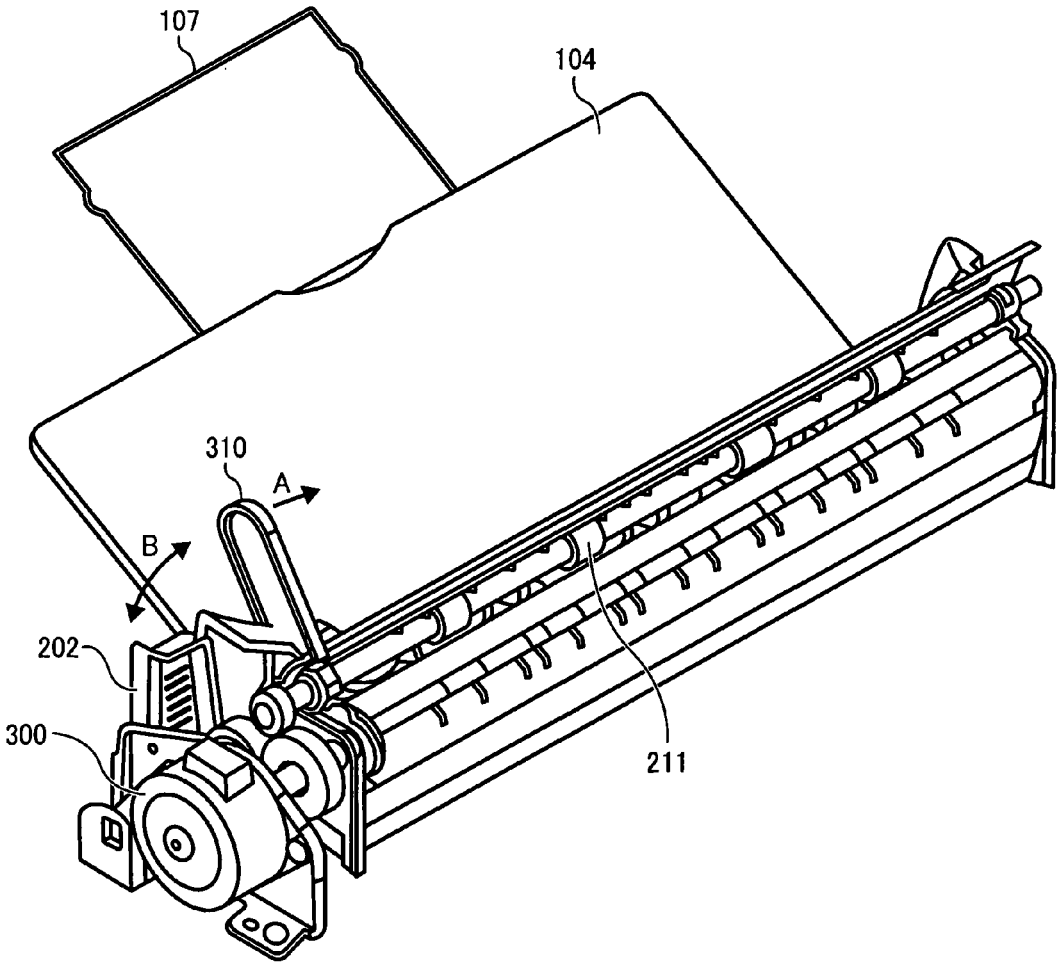
FIG. 11 is a perspective view illustrating how to rotate the discharge roller holder.
Figure 12A:
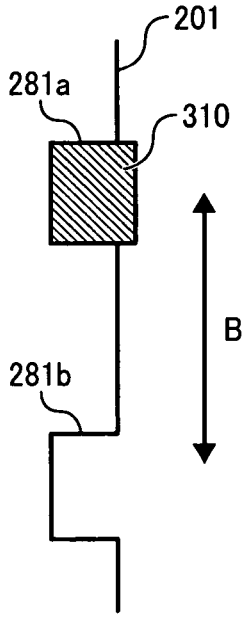
FIGS. 12A, 12B, and 12C relative positions of a lever of the discharge roller holder to the discharge frame, respectively.
Figure 12B:
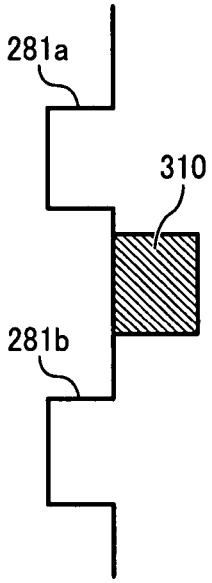
Figure 12C:
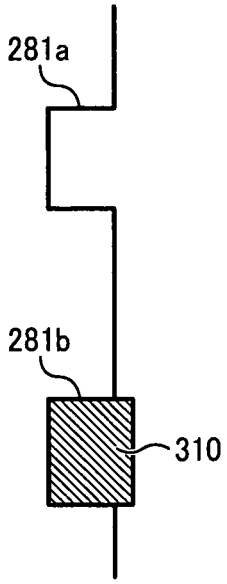

As shown in FIG. 11, a lever 310 is provided on the discharge roller holder 201, and the discharge roller holder 201 can be rotated by moving the lever 310. The discharge frame 201 includes positioning grooves 281*a* and 281*b*, shown in FIGS. 12A through 12C, each of which engages the lever 310. In the present embodiments, the lever 310 can be fixed at two different positions.

More specifically, when the lever 310 engages the positioning groove 281*a*, the discharge roller holder 201 is at a first discharge position. The lever 310 is a flexible member so as to be pulled down in a direction indicated by arrow A shown in FIG. 11, perpendicular to a direction indicated by arrow B shown in FIG. 11, in which the lever 310 is rotated (hereinafter "rotation direction B") to be disengaged from the positioning groove 281*a*. The lever 310 disengaged from the positioning groove 281*a* can be then rotated in the rotation direction B to engage the positioning groove 281*b*, and thus the discharge roller holder 201 is at a second discharge position. In addition, a stopper, not shown, is provided on the side to which the lever 310 is pulled down. While the discharge roller 213 is driven, the user cannot move the lever 310 because this stopper prevents the lever 310 from rotating, and thus safety is secured.

It is to be noted that the lever 310 is disposed on the driving side and its thrust direction phase preferably matches that of the driven gear 218 so that the movement of the lever 310 is not hindered by the engagement of the driven gear 218. This configuration can also prevent the force of the motor 300 applied to the discharge roller holder 201 from distorting the discharge roller holder 201.

The sheet discharge positions are described below with reference to FIG. 10.

At the first discharge position shown in FIGS. 1A, 8A, 9A, and 10A, the sheets are discharged in a space between the main body 1 and the scanner 4 regardless of on the first discharge tray 103 or on the second discharge tray 104. In this case, visibility of the sheets from above is good.

At the second discharge position shown in FIGS. 1B, 8B, 9B, and 10B, the sheets are discharged on the second discharge tray 104 that is closer to the front side of the image forming apparatus than the scanner 4 is. In this case, visibility of the sheets from the front side and from a lower side is good, and the sheets are less likely to curl.

Herein, if the sheet discharge direction from the discharge port 105 is more horizontal while the angle of the second discharge tray 104 is more vertical, that is, the sheets are discharged to the second discharge tray 104 that forms an angle closer to the right angle with the sheet discharge direction, it is possible that sheet discharge failures that sheets are jammed, that sheets are pushed out and tie like occur. Therefore, in the present embodiment, the angle of the second discharge tray 104 is changed in conjunction with the changes in the sheet discharge direction, and thus it can be prevented that the user improperly sets the sheet discharge direction and the angle of the second discharge tray 104 and that accordingly sheet discharge failures occur.

It is to be noted that, although the sheets are stacked on the second discharge tray 104 when the rotary unit 203 is at the second discharge position, the sheets can be reliably discharged by keeping the relative positions between the discharge port 105, the discharge nip direction, and the second discharge tray 104 identical or similar to the relative positions thereof when the rotary unit 203 is at the first discharge position.

With the above described configuration, the user can decide the location of the image forming apparatus more flexibly, for example, on the floor or on a rack. In addition, recording media that are liable to curl can be used, usability, which can enhance usability.

Moreover, in typical housing-internal discharge type image forming apparatuses that include a sheet discharge space inside a housing thereof, because the scanner tends to be disposed at a higher position, it is possible that the visibility of the discharged sheets may be insufficient and that the scanner and/or the frame holding the scanner may hinder the access to the discharged sheets. Therefore, the above described configuration is particularly advantageous for such housing-internal discharge type image forming apparatuses. Needless to say, the above described configuration is efficient for image forming apparatus without a scanner and certain cases in which a given object is present above the image forming apparatus, thus limiting the space above it.

As described above, in the present embodiment, because the sheets are discharged on the tray extending in the vertical direction, the visibility and the access to the sheets from the front side and from the lower side can be enhanced even when in tandem-type multicolor image forming apparatuses that include the sheet transport path disposed in its front portion to facilitate removal of jammed sheets from the front side.

In addition, the direction of the discharge nip where the discharge roller and the facing roller presses against each other, that is, the sheet discharge direction, is changeable. Therefore, even when the inclination of the discharge tray is changed, the angle at which the sheets reach the sheet stack face can be adjusted so that the sheets are smoothly reach the sheet stack face. Thus, damage to a tip portion of the sheets can be prevented, and a relatively large amount of sheets can be stacked neatly.

As the second discharge tray 104 and the extension tray 107 are housed inside the image forming apparatus, management of the components can be simplified.

Thus, in the above-described embodiment, the user can flexibly decide where to install the image forming apparatus and use the image forming apparatus conveniently.

As can be appreciated by those skilled in the art, although the description above concerns the intermediate transfer method, the above-described control of the transfer bias may be used in a direct transfer method in which a toner image on a photoreceptor is transferred directly onto a sheet of recording medium.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus to form an image on a sheet of recording media, comprising:

a discharge port formed in an upper portion of a main body of the image forming apparatus and exposed from above;

a discharge portion to which the sheet is discharged, disposed downstream from the discharge port in a direction in which a sheet is discharged;

a discharge roller disposed at the discharge port;

a facing member disposed facing the discharge roller, forming a discharge nip together with the discharge roller through which the sheet is discharged;

a rotatable sheet discharge member forming a sloped portion provided in the discharge portion, continuous with a downstream side of the discharge port in the direction in which the sheet is discharged, rotation of the sheet discharge member causing a position of the discharge nip to change;

a discharge roller holder to hold the discharge roller, the discharge roller holder including a transport rib and a facing guide including a transport face; and a discharge driving unit to rotate the sheet discharge member in conjunction with the discharge roller holder to change rotational positions thereof, wherein both a direction in which the sheet is discharged from the discharge port and an angle between the sheet discharge member and an upper surface of the main body are adjustable, an angle between the transport rib and the roller nip and an angle between the transport face and the discharge nip are substantially constant regardless of a position of the sheet discharge member, and the facing guide includes a notch overlapping the transport rib.

2. The image forming apparatus of claim 1, wherein the transport rib includes a plurality of ribs arranged in sets of two.

3. The image forming apparatus of claim 1, wherein the transport rib is configured to guide the sheet to the discharge nip.

4. The image forming apparatus of claim 1, wherein the facing guide is screwed to the discharge roller holder.

5. The image forming apparatus of claim 1, wherein the discharge roller holder includes positioning bosses configured to engage holes formed in the facing guide.

6. An image forming apparatus to form an image on a sheet of recording media, comprising:

a discharge port formed in an upper portion of a main body of the image forming apparatus and exposed from above;

a discharge portion to which the sheet is discharged, disposed downstream from the discharge port in a direction in which a sheet is discharged;

a discharge roller disposed at the discharge port;

a facing member disposed facing the discharge roller, forming a discharge nip together with the discharge roller through which the sheet is discharged;

a rotatable sheet discharge member forming a sloped portion provided in the discharge portion, continuous with a downstream side of the discharge port in the direction in which the sheet is discharged, rotation of the sheet discharge member causing a position of the discharge nip to change;

a discharge roller holder to hold the discharge roller, the discharge roller holder including a transport rib and a facing guide including a transport face; and a discharge driving unit to rotate the sheet discharge member in conjunction with the discharge roller holder to change rotational positions thereof, wherein both a direction in which the sheet is discharged from the discharge port and an angle between the sheet discharge member and an upper surface of the main body are adjustable and an angle between the transport rib and the roller nip and an angle between the transport face and the discharge nip are substantially constant regardless of a position of the sheet discharge member, and the discharge roller holder and the facing guide are integrated into a single rotary unit.

7. An image forming apparatus configured to form an image on a sheet of recording media, comprising:

a discharge port in an upper portion of a main body of the image forming apparatus and exposed from above;

a discharge portion to which the sheet is discharged, the discharge portion being arranged downstream from the discharge port in a direction in which the sheet is discharged;

a discharge roller at the discharge port;

a facing member facing the discharge roller, the facing member forming a discharge nip together with the discharge roller through which the sheet is discharged;

a scanner configured to read image data of an original document, the scanner being arranged above the main body so as not to overlap the discharge port in a vertical direction, the scanner also being arranged downstream from the discharge portion in the direction in which the sheet is discharged; and a rotatable sheet discharge member including a sloped portion provided in the discharge portion, the sloped portion being continuous with a downstream side of the discharge port in the direction in which the sheet is discharged, rotation of the rotatable sheet discharge member causing a position of the discharge nip to change, the rotatable sheet discharge member including a discharge tray that forms the sloped portion, the rotatable sheet discharge member being configured to rotate the discharge tray from a first position to a second position, wherein in the first position the discharge tray is one of inside the main body of the image forming apparatus and on the main body of the image forming apparatus and in the second position a downstream edge portion of the discharge tray is upstream from the scanner in the direction in which the sheet is discharged, the rotatable sheet discharge member is configured to discharge the sheet between the discharge portion and the scanner when the discharge tray is in the first position, and the rotatable sheet discharge member is configured to discharge the sheet upstream from the scanner in the direction in which the sheet is discharged when the discharge tray is in the second position.

8. The image forming apparatus of claim 7, further comprising:

a control panel overlapping the discharge port and the discharge portion in a horizontal direction.

9. The image forming apparatus of claim 7, wherein the discharge tray includes an extension tray configured to be drawn out from the discharge tray in the direction in which the sheet is discharged and a downstream end portion of the extension tray is configured to engage an upstream edge portion of the scanner in the direction in which the sheet is discharged when the extension tray is at an extended position, drawn out from the discharge tray.

10. The image forming apparatus of claim 9, wherein the downstream edge portion of the discharge tray includes a recessed portion and the extension tray is visible through the recessed portion when the extension tray is at a contracted position.

11. The image forming apparatus of claim 9, wherein the discharge tray includes a recessed portion in the downstream edge portion.

* * * * *